US011158280B2

(12) United States Patent
Kuo et al.

(10) Patent No.: US 11,158,280 B2
(45) Date of Patent: Oct. 26, 2021

(54) METHOD OF CONTROLLING IMAGE DATA AND RELATED SOURCE DRIVER

(71) Applicant: NOVATEK Microelectronics Corp., Hsin-Chu (TW)

(72) Inventors: Te-Hsien Kuo, Keelung (TW); Chin-Hung Hsu, Taoyuan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/459,583

(22) Filed: Jul. 1, 2019

(65) Prior Publication Data

US 2020/0234669 A1 Jul. 23, 2020

Related U.S. Application Data

(60) Provisional application No. 62/795,033, filed on Jan. 22, 2019.

(51) Int. Cl.
*G09G 3/36* (2006.01)

(52) U.S. Cl.
CPC ..... *G09G 3/3696* (2013.01); *G09G 2330/023* (2013.01); *G09G 2340/16* (2013.01); *G09G 2360/18* (2013.01)

(58) Field of Classification Search
CPC .. G09G 3/3685; G09G 3/3696; G09G 3/3674; G09G 2330/045; G09G 2330/041; G09G 2330/08; G09G 2310/08; G09G 2330/12; G09G 2330/04; G09G 3/3614; G09G 3/3611; G09G 2330/021
See application file for complete search history.

(56) References Cited

U.S. PATENT DOCUMENTS

| | | | | |
|---|---|---|---|---|
| 9,978,332 | B2 * | 5/2018 | Lee | G09G 3/3648 |
| 2007/0090347 | A1 * | 4/2007 | Park | G09G 3/3283 257/40 |
| 2009/0278779 | A1 * | 11/2009 | Liu | G09G 3/3688 345/98 |
| 2010/0315402 | A1 * | 12/2010 | Hashimoto | G09G 3/3648 345/211 |
| 2013/0235026 | A1 * | 9/2013 | Yamamoto | G11C 19/184 345/214 |
| 2014/0152634 | A1 * | 6/2014 | Shibata | G09G 3/3614 345/209 |
| 2015/0194110 | A1 * | 7/2015 | Park | G09G 3/3614 345/213 |
| 2015/0228241 | A1 * | 8/2015 | Lee | G09G 3/3688 345/212 |
| 2016/0093237 | A1 * | 3/2016 | Lee | G09G 3/3688 345/690 |
| 2016/0104450 | A1 * | 4/2016 | Lee | G09G 3/3688 345/211 |
| 2016/0335970 | A1 * | 11/2016 | Cheng | G09G 3/3674 |

* cited by examiner

*Primary Examiner* — Md Saiful A Siddiqui
(74) *Attorney, Agent, or Firm* — Winston Hsu

(57) ABSTRACT

A method of controlling image data includes the steps of: detecting a frame of image data to determine an image pattern of the frame of image data; and determining to output the frame of image data with one of a plurality of configurations according to the image pattern. Wherein, a first configuration among the plurality of configurations indicates that the frame of image data is outputted in a first sequence and a second configuration among the plurality of configurations indicates that the frame of image data is outputted in a second sequence different from the first sequence.

10 Claims, 10 Drawing Sheets

METHOD OF CONTROLLING IMAGE DATA AND RELATED SOURCE DRIVER

CROSS REFERENCE TO RELATED APPLICATIONS

This application claims the benefit of U.S. Provisional Application No. 62/795,033, filed on Jan. 22, 2019, the contents of which are incorporated herein by reference.

BACKGROUND OF THE INVENTION

1. Field of the Invention

The present invention relates to a method of controlling image data and a related source driver, and more particularly, to a method of controlling image data and a related source driver for power saving.

2. Description of the Prior Art

A liquid crystal display (LCD), which is a flat panel display having the advantages of low radiation, light weight and low power consumption, is widely used in various information technology (IT) products such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source driver(s) and gate driver(s). The source and gate drivers respectively control data lines and scan lines, which intersect to form a cell matrix. Each intersection is a cell including crystal display molecules and a TFT. In the driving system, the gate driver is responsible for transmitting scan signals to gates of the TFTs to turn on the TFTs on the panel. The source driver is responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

The normal operation always scans the scan lines on the LCD panel to turn on the TFTs row by row in a fixed order from up to down, and the data lines on the LCD panel are charged to specific voltage levels, to output the image data to the turned-on TFTs. In this manner, most power consumption of the LCD device is generated by charging the data lines. With increasing demands of large scale TFT LCD panels and high resolution requirements, more and more cells are included in an LCD panel; this increases power consumption much more. Thus, how to reduce power consumption of the LCD panel has become an important issue in this art.

SUMMARY OF THE INVENTION

It is therefore an objective of the present invention to provide a method of controlling image data and a related source driver for a display device, in order to reduce power consumption of the display device.

An embodiment of the present invention discloses a method of controlling image data. The method comprises the steps of: detecting a frame of image data to determine an image pattern of the frame of image data; and determining to output the frame of image data with one of a plurality of configurations according to the image pattern. Wherein, a first configuration among the plurality of configurations indicates that the frame of image data is outputted in a first sequence and a second configuration among the plurality of configurations indicates that the frame of image data is outputted in a second sequence different from the first sequence.

Another embodiment of the present invention discloses a source driver, which comprises a plurality of channels. Each of the plurality of channels comprises a shift register, a first data latch, a plurality of second data latches, a digital to analog converter (DAC) and an output buffer. The first data latch is coupled to the shift register. Each of the plurality of second data latches is coupled to the first data latch. The DAC is coupled to each of the plurality of second data latches. The output buffer is coupled to the DAC.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
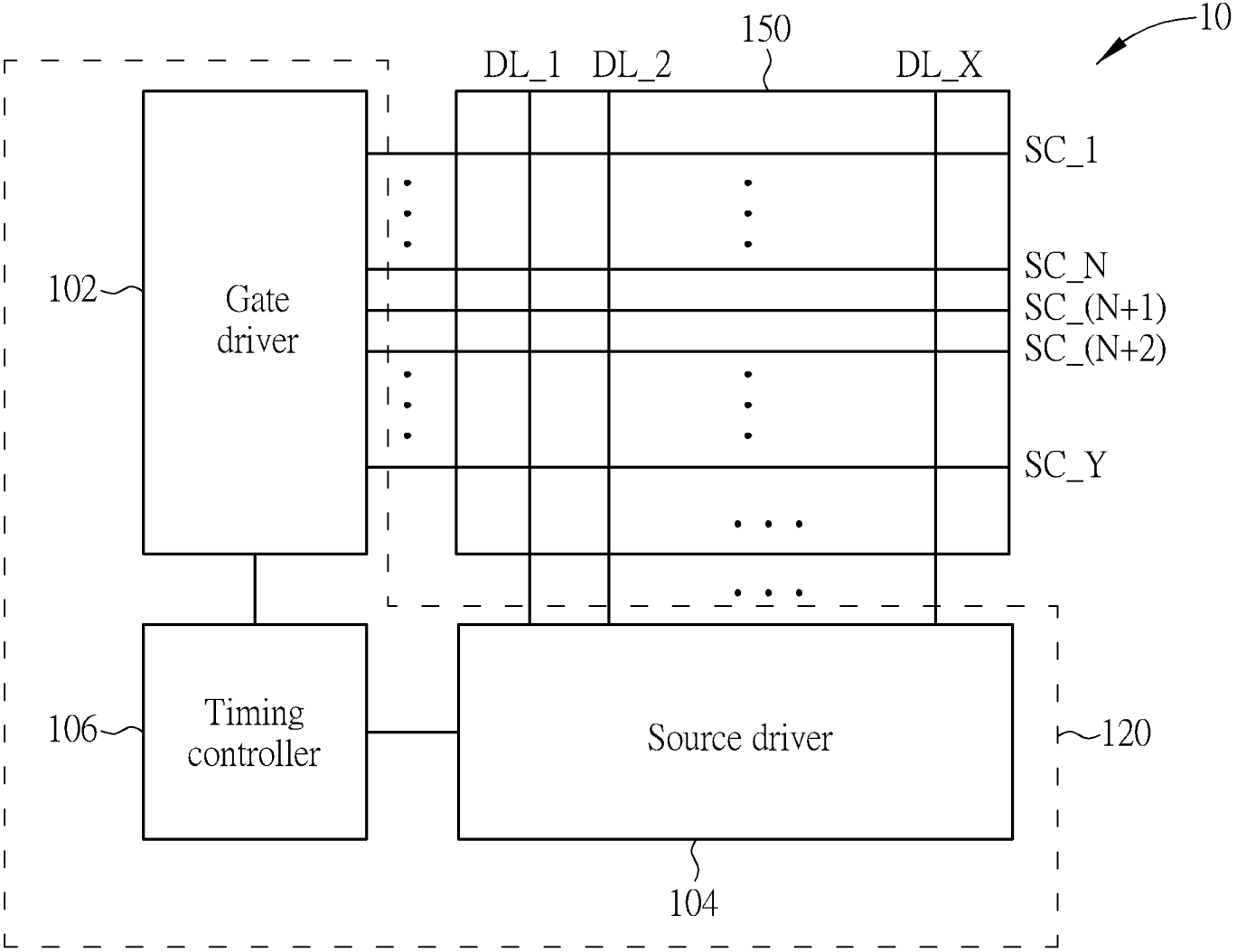
FIG. 1 is a schematic diagram of a display device according to an embodiment of the present invention.

Please refer to FIG. 1, which is a schematic diagram of a display device 10 according to an embodiment of the present invention. As shown in FIG. 1, the display device 10 includes a driving system 120 and a panel 150. The display device 10 may be a liquid crystal display (LCD) device or other type of display device. The driving system 120, which is configured to control image data displayed on the panel 150, includes a gate driver 102, a source driver 104 and a timing controller 106. The gate driver 102 is configured to output gate driving signals via scan lines SC_1-SC_Y on the panel 150, to turn on the transistors on the panel 150 row by row, allowing the turned-on transistors to receive image data. The source driver 104 is configured to output voltage signals as image data to data lines DL_1-DL_X. The timing controller 106 is configured to control the operations of the gate driver 102 and the source driver 104. In detail, the timing controller 106 controls the gate driver 102 to turn on the transistors row by row, and controls the source driver 104 to output data corresponding to the turned-on transistors in each row in a sequence, to display the image data in each row of pixels. For example, a general display operation may start from the scan line SC_1, and then go through the scan lines SC_2, SC_3, SC_4, . . . , until the last row (i.e., the scan line SC_Y) to complete an image frame. After the image data corresponding to the scan line SC_Y is outputted to the panel 150, the display operation then repeats from the first row (i.e., the scan line SC_1) in the next frame cycle.

Figure 2B:
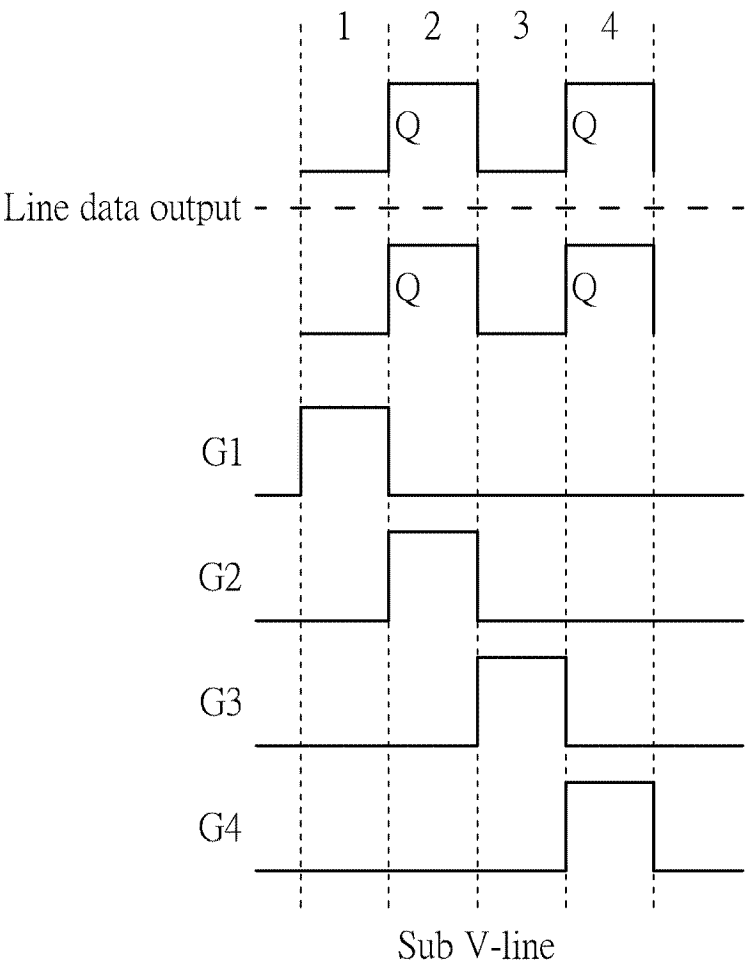
FIGS. 2A and 2B are schematic diagrams of the heavy-load image patterns.
Figure 2A:
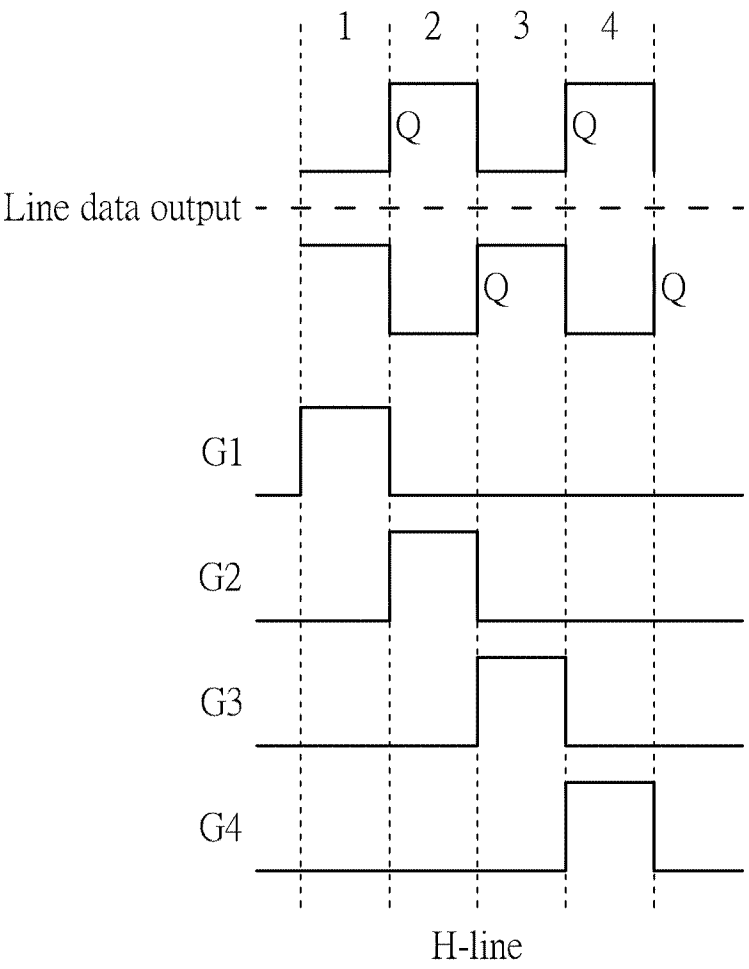

As mentioned above, in a driving system of a display device such as the driving system 120, most power consumption originates from charging of the data lines DL_1-DL_X. Larger data variations may usually require more electric charge quantity, and thereby consume more power. The power consumption is extremely large in several heavy-load image patterns such as the H-line pattern and sub V-line pattern, as shown in FIGS. 2A and 2B. In detail, FIGS. 2A and 2B illustrate the waveforms of line data in positive polarity and negative polarity outputted to every two adjacent data lines, respectively, and the waveforms of gate driving signals G1-G4 for respectively driving four adjacent scan lines such as the scan lines SC_1-SC_4 shown in FIG. 1. The H-line pattern shows horizontal lines of the highest image data alternating with the lowest image data. The sub V-line pattern shows vertical subpixel lines of the highest image data alternating with the lowest image data in a panel having zig-zag structure where two columns of subpixels share the same data line. These image patterns may generate large power consumption and thus may be considered as the heavy-load patterns. As shown in FIGS. 2A and 2B, electric power is required when data is charged from a lower voltage level to a higher voltage level, and Q denotes an amount of power consumed by charging the data lines from low to high.

In the H-line pattern as shown in FIG. 2A and the sub V-line pattern as shown in FIG. 2B, the gate driving signals G1-G4 are triggered in a normal sequence, i.e., in an order of G1, G2, G3 and G4. In such a situation, the power amount consumed by the H-line pattern or the sub V-line pattern is equal to 4Q in every two data lines.

Figure 3B:
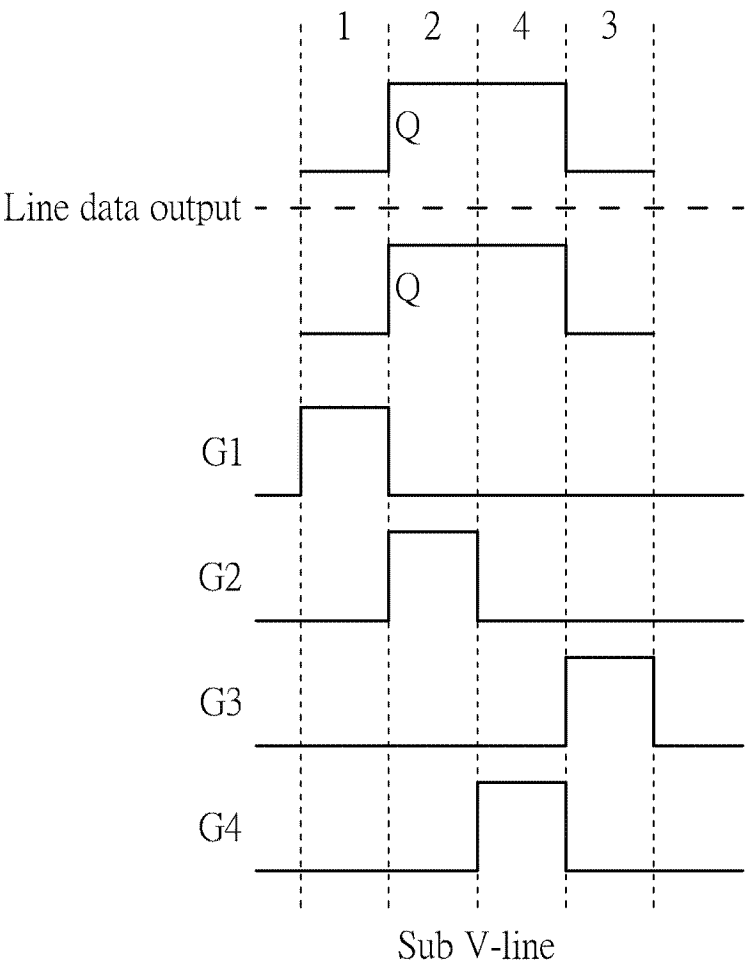
FIGS. 3A and 3B are schematic diagrams of swapping the order of outputting line data in the heavy-load image patterns according to an embodiment of the present invention.
Figure 3A:
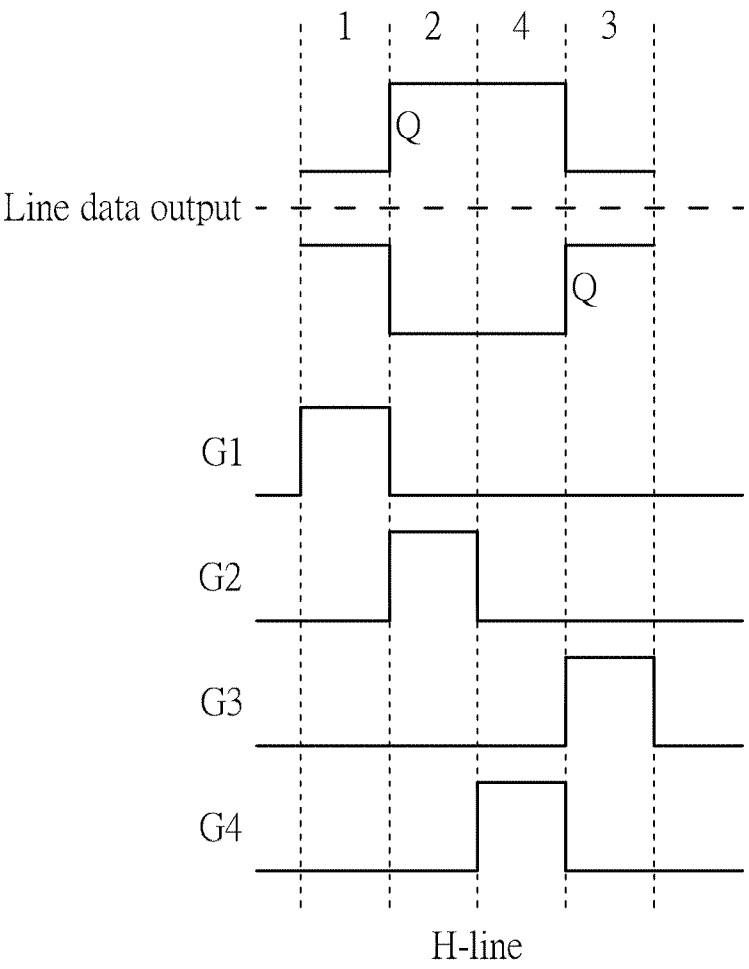

Therefore, in order to reduce power consumption by reducing the degree of data variations, the present invention may detect the image pattern of each image frame and swap the order of displaying the line data accordingly. Please refer to FIGS. 3A and 3B, which are schematic diagrams of swapping the order of outputting line data in the heavy-load image patterns according to an embodiment of the present invention. FIG. 3A illustrates the H-line pattern and FIG. 3B illustrates the sub V-line pattern. As shown in FIGS. 3A and 3B, the output orders of the third line data and the fourth line data are swapped. The orders of triggering the gate driving signals G3 and G4 are correspondingly interchanged, in order to prevent unwanted change of image content. In other words, the gate driving signals G1-G4 are triggered in a swap sequence, i.e., in an order of G1, G2, G4 and G3. In such a situation, the power amount consumed by the H-line pattern or the sub V-line pattern is equal to 2Q in every two data lines; hence, the swap configuration reduces the quantity of power consumption by half. Due to reduction of power consumption, the overheating problem can also be resolved or mitigated.

In an embodiment, a pattern detect function (PDF) module of the timing controller 106 is applied to detect each frame of image data to determine the image pattern of each image frame. Therefore, the timing controller 106 may determine that the image frame conforms to a specific heavy-load image pattern, and thus output the image frame or control the source driver to output the image frame with a specific configuration according to the image frame. The specific configuration may indicate the output orders of the line data in the image frame, so as to achieve reduction of power consumption.

Figure 4:
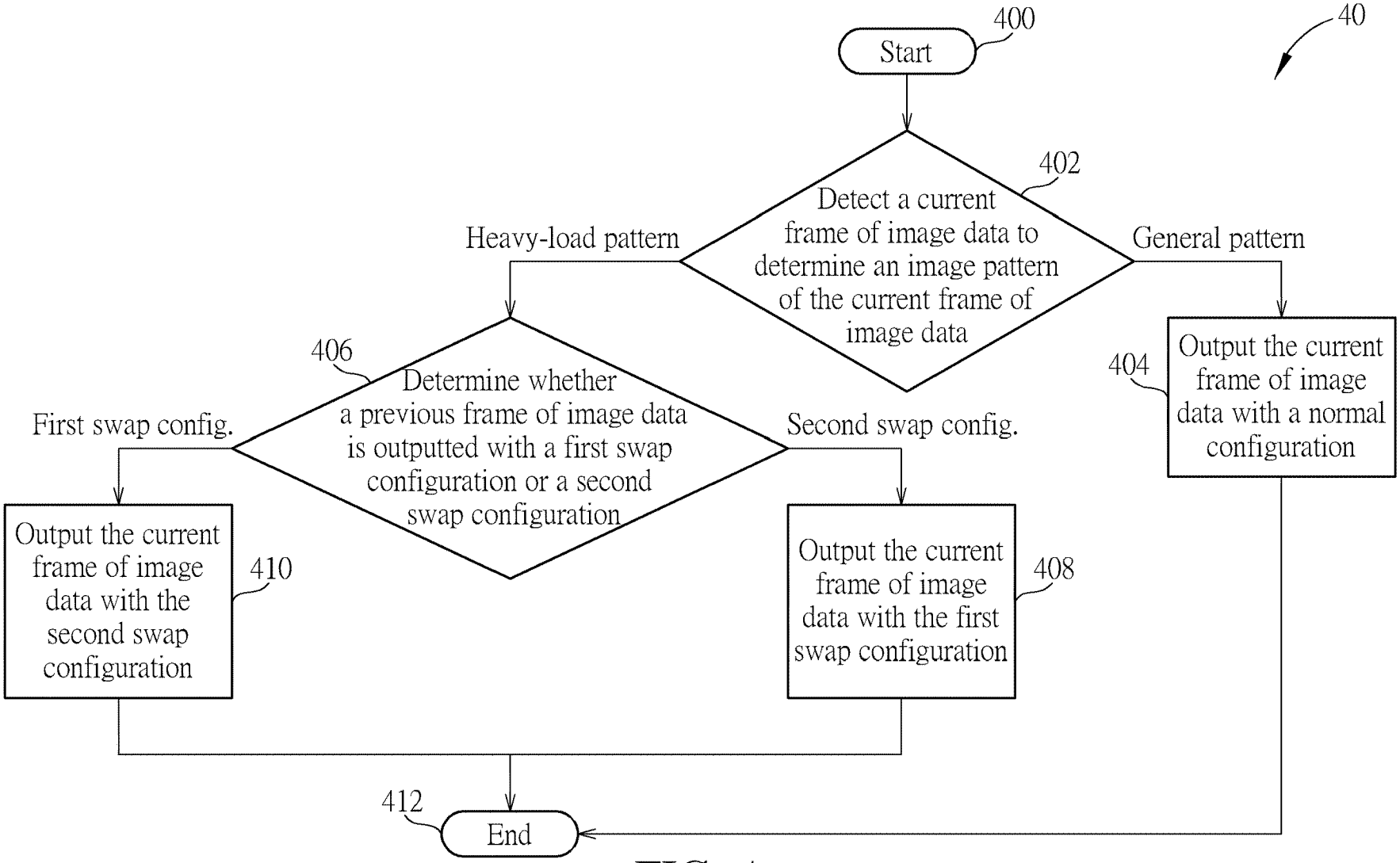
FIG. 4 is a flowchart of an image control process according to an embodiment of the present invention.

Please refer to FIG. 4, which is a flowchart of an image control process 40 according to an embodiment of the present invention. The image control process 40 may be implemented in a driving system of a display device, such as the driving system 120 shown in FIG. 1, for controlling image data to be displayed on the panel 150. As shown in FIG. 4, the image control process 40 includes the following steps:

Step 400: Start.

Step 402: Detect a current frame of image data to determine an image pattern of the current frame of image data. If the image pattern is determined to be a heavy-load pattern, go to Step 406; if the image pattern is determined to be a general pattern, go to Step 404.

Step 404: Output the current frame of image data with a normal configuration. Then go to Step 412.

Step 406: Determine whether a previous frame of image data is outputted with a first swap configuration or a second swap configuration. If the previous frame of image data is outputted with the second swap configuration, go to Step 408; if the previous frame of image data is outputted with the first swap configuration, go to Step 410.

Step 408: Output the current frame of image data with the first swap configuration. Then go to Step 412.

Step 410: Output the current frame of image data with the second swap configuration.

Step 412: End.

According to the image control process 40, an incoming image frame is detected and its image pattern is determined, e.g., via the PDF module of the timing controller 106. Several heavy-load image patterns such as the H-line pattern and the sub V-line pattern are predetermined. If the image frame is determined to be far different from any of the heavy-load image pattern (e.g., the difference between the image frame and every heavy-load image pattern is greater than a threshold), a normal configuration may be applied, where the line data of the image frame are outputted to the panel 150 in a normal sequence from up to down. If the image frame is determined to be similar to or identical to one of the heavy-load image patterns (e.g., the difference between the image frame and a heavy-load image pattern is less than a threshold), a swap configuration may be applied. The swap configuration indicates that the output orders of several line data are swapped with reference to the output orders in the normal configuration.

Please continue to refer to FIGS. 3A and 3B, where the output orders of the third line data and the fourth line data are swapped so as to reduce power consumption. In these heavy-load patterns, power reduction may also be achieved by swapping the output orders of the first line data and the second line data. Therefore, two different swap configurations may be applied. In detail, the frame of image data may be separated into two groups of line data, where the first group includes every $(4n+3)^{th}$ line data and $(4n+4)^{th}$ line data wherein n is a positive integer, and the second group includes every $(4n+1)^{th}$ line data and $(4n+2)^{th}$ line data. In a first swap configuration, the output orders of every two adjacent line data in the first group are swapped; that is, the $3^{rd}$ and $4^{th}$ line data are swapped, the $7^{th}$ and $8^{th}$ line data are swapped, the $11^{th}$ and the $12^{th}$ line data are swapped, and so on. The trigger orders of the corresponding gate driving signals are swapped accordingly. In a second swap configuration, the output orders of every two adjacent line data in the second group are swapped; that is, the $1^{st}$ and $2^{nd}$ line data are swapped, the $5^{th}$ and $6^{th}$ line data are swapped, the $9^{th}$ and $10^{th}$ line data are swapped, and so on. The trigger orders of the corresponding gate driving signals are swapped accordingly.

In general, if there are more than two different swap configurations, the timing controller 106 may control the image frame to be outputted with an appropriate swap configuration. In the embodiment shown in FIG. 4, the first swap configuration and the second swap configuration are interchangeably applied to a plurality of consecutive image frames if these image frames are determined to have heavy-load pattern(s) which indicate(s) that swapping of line data is required. In detail, if the previous image frame determined to have a heavy-load pattern is outputted with the first swap configuration, the current image frame may be outputted with the second swap configuration. If the previous image frame determined to have a heavy-load pattern is outputted with the second swap configuration, the current image frame may be outputted with the first swap configuration.

The flowchart shown in FIG. 4 is applicable to every incoming image frame, and only those image frames determined to have heavy-load patterns are outputted with swap configurations. The total power consumption may be reduced by well controlling the power consumption of the heavy-load image frames. This achieves satisfactory power reduction effects without using a complex determination scheme and a great amount of computation resource. In addition, different swap configurations may be applied and controlled for a series of image frames. For example, the swap scheme may change to use the first swap configuration after the second swap configuration is applied to five consecutive heavy-load image frames, or use the second swap configuration after the first swap configuration is applied to three consecutive heavy-load image frames.

Figure 5B:
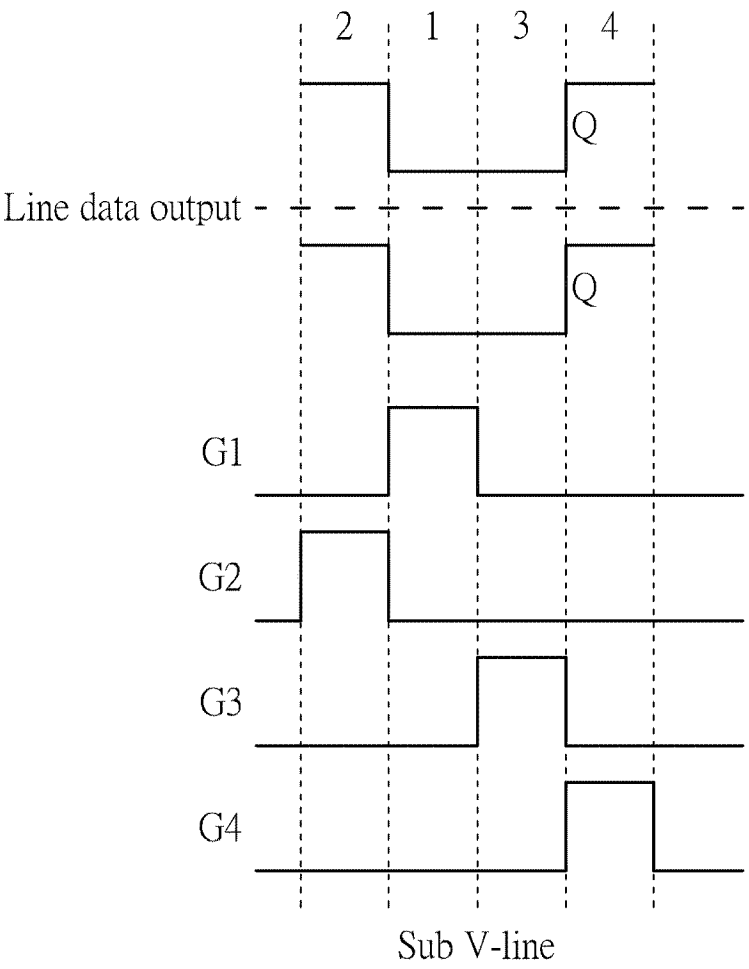
FIGS. 5A and 5B are schematic diagrams of the heavy-load image patterns with another swap sequence.
Figure 5A:
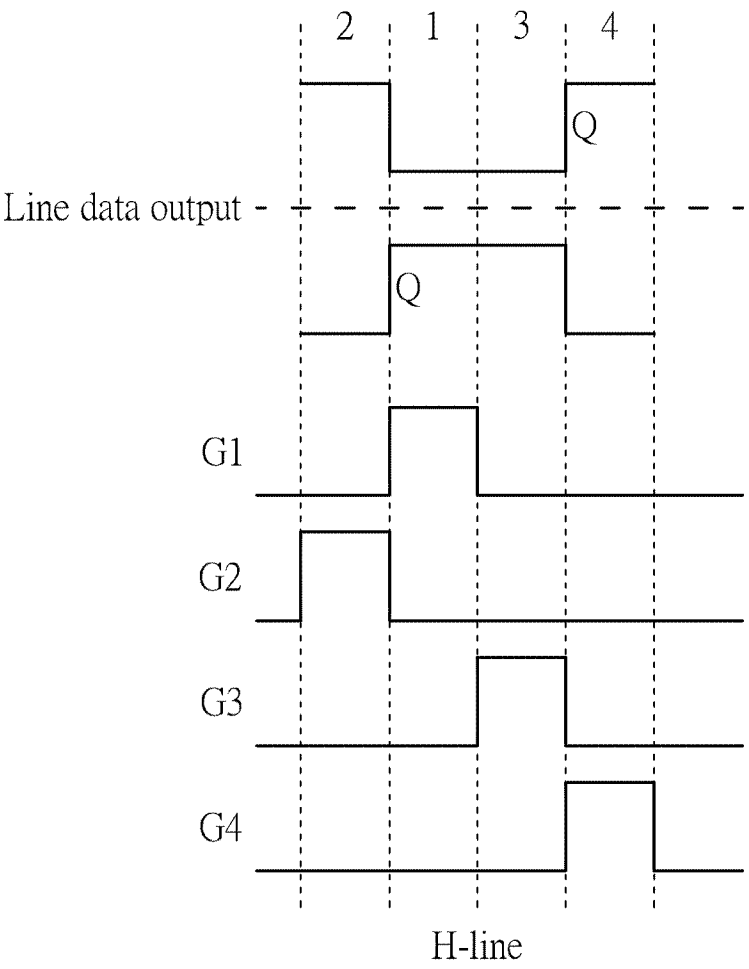

Please continue to refer to FIGS. 3A and 3B together with FIGS. 5A and 5B. In the swap scheme shown in FIGS. 3A and 3B where the third line data and the fourth line data are swapped, charging of data lines only appears at the start of the second data cycle (taking the image data of positive polarity as an example). Note that in the heavy-load image patterns such as the H-line pattern and the sub V-line pattern, the charging operation requires to charge a data line from the lowest level to the highest level; hence, the problem of insufficient charging may easily appear under limited charging time. Therefore, in the first swap configuration where the $(4n+3)^{th}$ line data and the $(4n+4)^{th}$ line data are swapped, the insufficient charging problem may easily appear on the $(4n+2)^{th}$ line data, causing the brightness of the $(4n+2)^{th}$ rows of pixels to be lower than their expected brightness. Similarly, in the swap scheme shown in FIGS. 5A and 5B where the first line data and the second line data are swapped, charging of data lines only appears at the start of the fourth data cycle (taking the image data of positive polarity as an example). Therefore, in the second swap configuration where the $(4n+1)^{th}$ line data and the $(4n+2)^{th}$ line data are swapped, the insufficient charging problem may easily appear on the $(4n+4)^{th}$ line data, causing the brightness of the $(4n+4)^{th}$ rows of pixels to be lower than their expected brightness. In such a situation, interchange of the usage of the first swap configuration and the second swap configuration prevents the unexpected lower brightness from continuously appearing in the same rows. In this manner, the output brightness of a series of image frames may be well balanced, which mitigates the visual defects caused by the insufficient charging problem.

Figure 6:
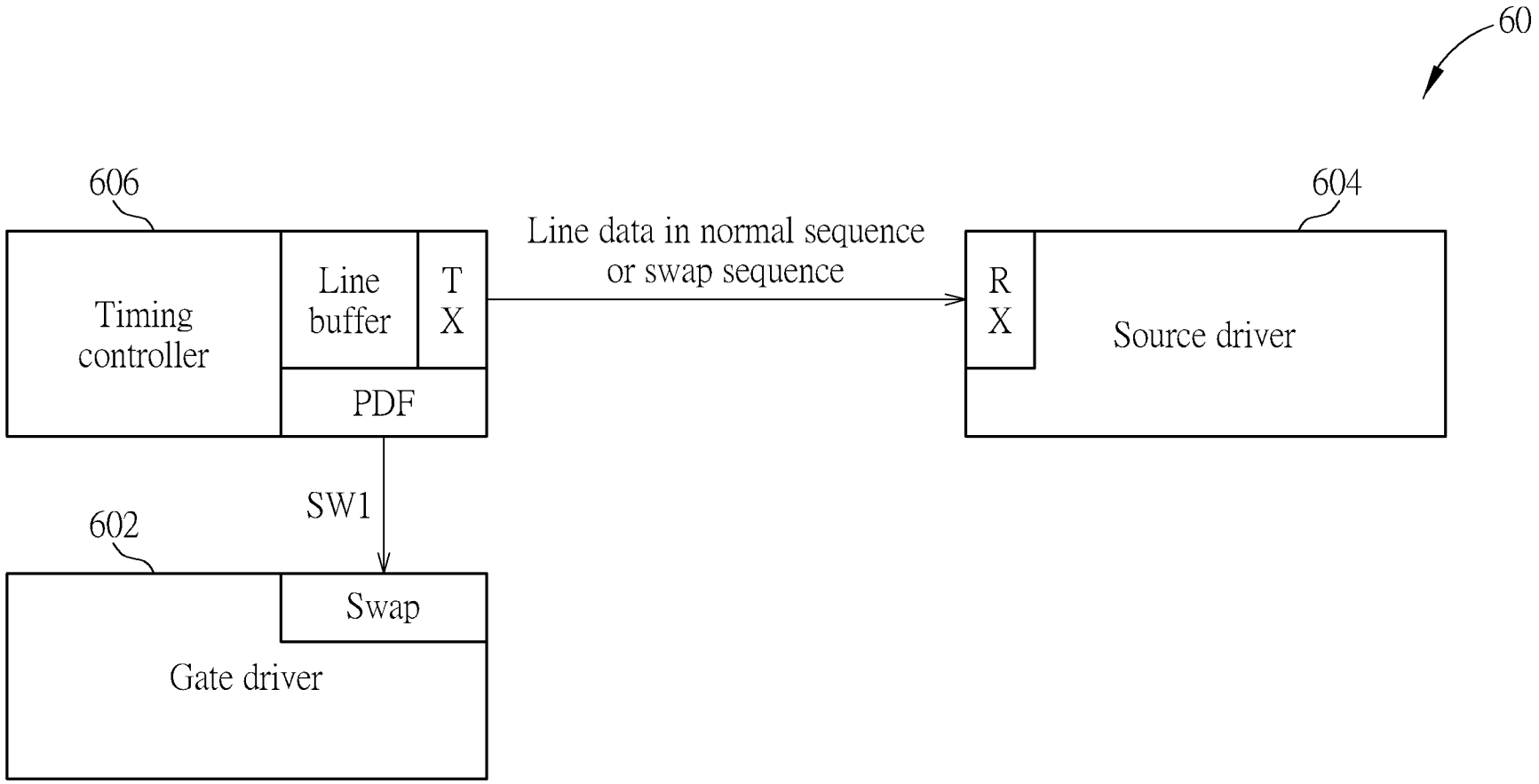
FIG. 6 is a schematic diagram of a driving system according to an embodiment of the present invention.

In an embodiment, the swap scheme may be implemented in the timing controller. Please refer to FIG. 6, which is a schematic diagram of a driving system 60 according to an embodiment of the present invention. As shown in FIG. 6, the driving system 60 includes a gate driver 602, a source driver 604 and a timing controller 606. The general operations of the gate driver 602, the source driver 604 and the timing controller 606 are similar to those of the gate driver 102, the source driver 104 and the timing controller 106, and will be omitted herein.

In order to realize the image pattern detection, the timing controller 606 includes a PDF module, which is configured to detect each image frame and determine whether the image frame belongs to any heavy-load image pattern. Based on the detection result of image pattern, the timing controller 606 may output a frame of image data to the source driver 604 in a sequence indicated by the configuration determined by the timing controller 606. For example, a normal configuration may indicate that the timing controller 606 outputs the line data to the source driver 604 in a normal sequence, and a swap configuration may indicate that the timing controller 606 outputs the line data to the source driver 604 in a swap sequence. The timing controller 606 may further send a swap signal SW1 to the gate driver 602. The swap signal SW1 may be received by a swap module of the gate driver 602, to control the gate driver 602 to trigger gate driving signals in a sequence indicated by the normal or swap configuration. In an embodiment, the gate driver 602 may have a gate on array (GOA) structure implemented on the substrate of the panel. The timing controller 606 may send the swap signal SW1 to the GOA circuit on the panel to control the trigger orders of the gate driving signals.

As shown in FIG. 6, the timing controller 606 further includes a line buffer and a transmitter (TX). The transmitter is configured to transmit image data to the source driver 604, and the image data are received by a receiver (RX) of the source driver 604. The line buffer is configured to store line data when a swap configuration is applied. For example, if the swap configuration indicates that the output orders of the first line data and the second line data are swapped, the second line data may be outputted before the first line data; hence, the first line data received prior to the second line data should be stored in the line buffer, and then outputted to the source driver 604 after the second line data. The timing controller 606 may determine which swap configuration is applied and thereby control corresponding line data to be stored in the line buffer. In this embodiment, the source driver 604 may operate normally no matter which configuration is applied. Since the line data received by the source driver 604 are in a proper sequence controlled by the timing controller 606, the line data may be directly outputted to a panel by the source driver 604, and the reduction of power consumption may be achieved without any additional efforts of the source driver 604.

Figure 7:
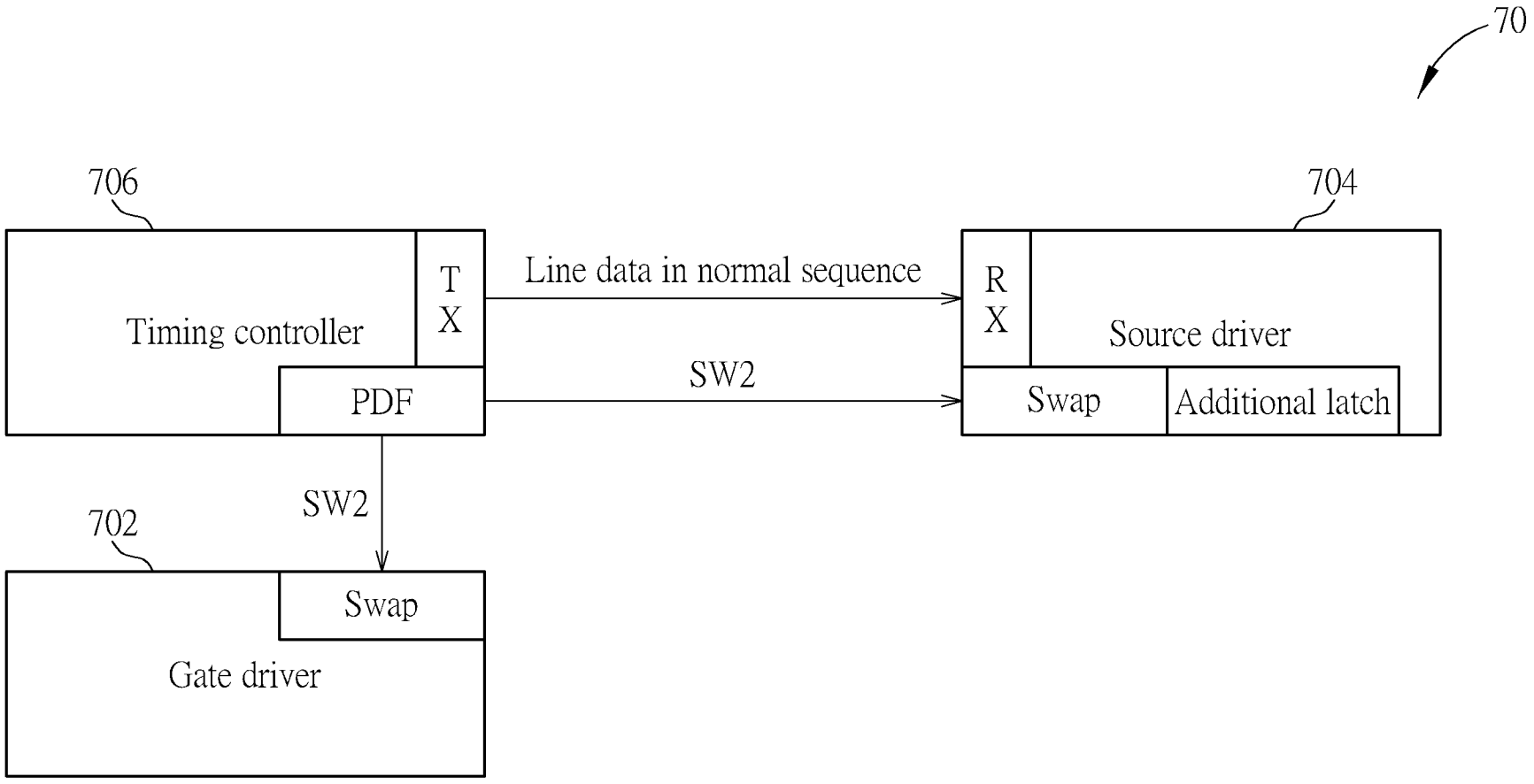
FIG. 7 is a schematic diagram of a driving system according to an embodiment of the present invention.

In another embodiment, the swap scheme may be implemented in the source driver. Please refer to FIG. 7, which is a schematic diagram of a driving system 70 according to an embodiment of the present invention. As shown in FIG. 7, the driving system 70 includes a gate driver 702, a source driver 704 and a timing controller 706. The general operations of the gate driver 702, the source driver 704 and the timing controller 706 are similar to those of the gate driver 102, the source driver 104 and the timing controller 106, and will be omitted herein.

Similar to the timing controller 606, the timing controller 706 shown in FIG. 7 also includes a PDF module for detecting the image frames and determining whether each image frame belongs to any heavy-load image pattern. The timing controller 706 and the source driver 704 respectively include a transmitter and a receiver for transmitting and receiving image data. In this embodiment, the source driver 704 further includes a swap module, which is configured to receive a swap signal SW2 from the timing controller 706, in order to control the output orders of line data according to the swap signal SW2. More specifically, the timing controller 706 may determine which configuration should be applied, and thereby send the swap signal SW2 to the source driver 704, in order to instruct the source driver 704 to output line data to the panel in a specific sequence. In such a situation, the timing controller 706 may output a frame of image data to the source driver 704 in a normal sequence, and the source driver 704 may output the frame of image data to the panel in a sequence indicated by the configuration determined by the timing controller 706 and forwarded via the swap signal SW2. For example, a normal configuration may indicate that the source driver 704 outputs the line data to the panel in a normal sequence, and a swap configuration may indicate that the source driver 704 outputs the line data to the panel in a swap sequence. The timing controller 706 may further send the swap signal SW2 (or another similar control signal) to the gate driver 702, to control the gate driver 702 to trigger gate driving signals in a sequence corresponding to the output orders of the line data.

In order to realize the swap of line data, the source driver 704 may further include additional data latches for storing the image data, as shown in FIG. 7. In an embodiment, an additional data latch is included in each channel of the source driver 704; that is, each channel of the source driver 704 may include one first data latch and two second data latches, where the first data latch is configured to sequentially receive image data, and the first data latch may forward the received image data to one of the second data latches in parallel. The additional second data latch is capable of storing a previously received image data which is required to be outputted later, so as to swap the output orders of image data.

Figure 8:
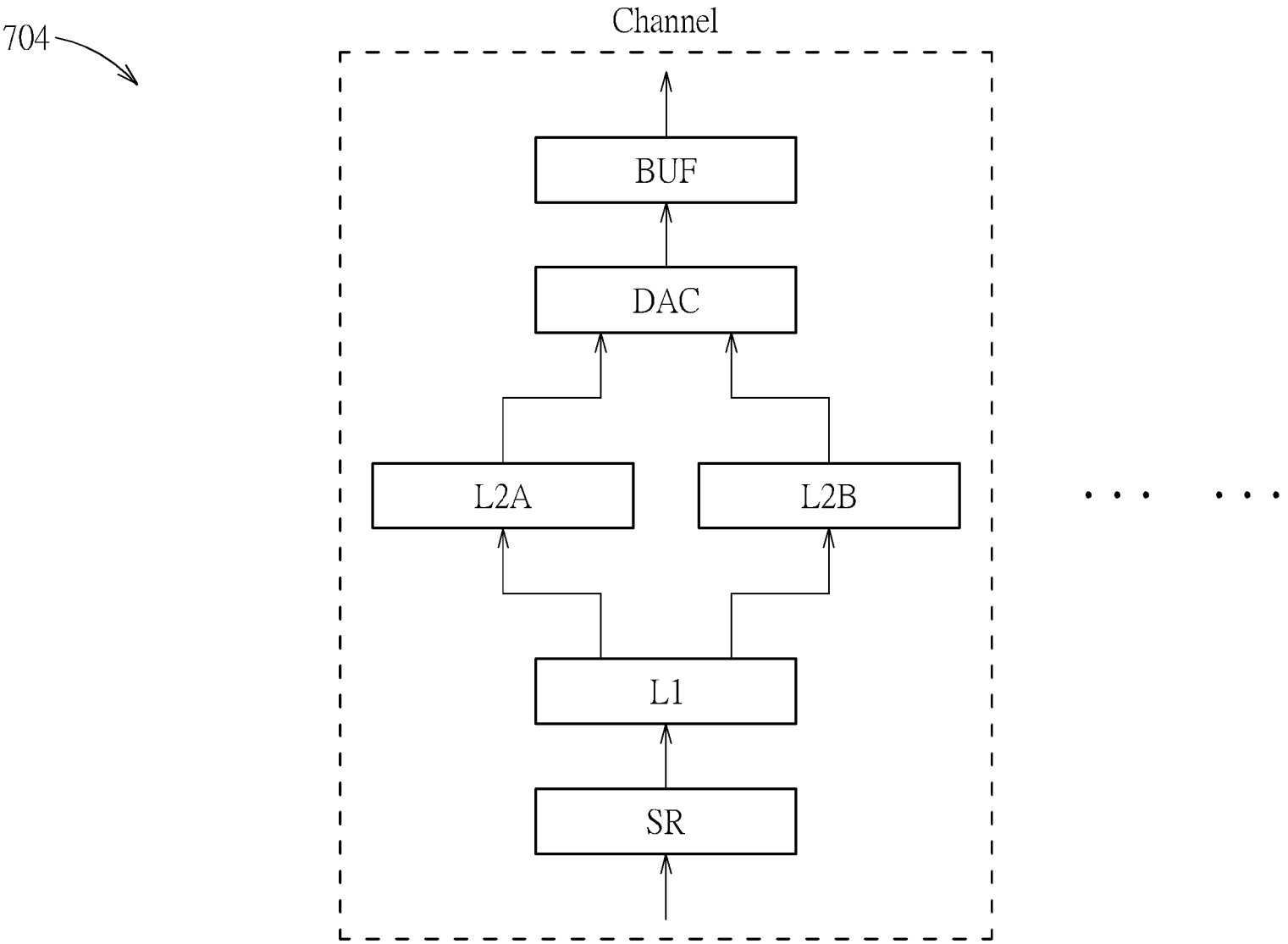
FIG. 8 is a schematic diagram of a detailed implementation of the source driver.

Please refer to FIG. 8, which is a schematic diagram of a detailed implementation of the source driver 704. As shown in FIG. 8, the source driver 704 includes a plurality of channels, and each channel includes a shift register SR, a first data latch L1, two second data latches L2A and L2B, a digital to analog converter (DAC), and an output buffer BUF. The shift register SR is configured to forward image data to the first data latch L1 or control the first data latch L1 to receive image data from the timing controller. The first data latch L1, coupled to the shift register SR, is configured to receive the image data and forward the image data to one of the second data latches L2A and L2B. In detail, the first data latch L1 in each channel receives the corresponding image data sequentially based on the control of the shift register SR. When a control signal (such as a LD signal) is received, the first data latch L1 in each channel simultaneously sends the image data to one of the second data latches L2A and L2B. For each input image data in an image frame, the first data latch L1 may forward the input image to a selected second data latch L2A or L2B according to the image pattern of the image frame and the related configuration.

Subsequently, one of the second data latches L2A and L2B may output a selected image data to the DAC, and the DAC converts the image data to a corresponding analog signal, which is forwarded by the output buffer BUF to the panel. The output buffer BUF may be an operational amplifier for driving the data line on the panel to change its voltage levels based on the analog signal. An output image data of the channel outputted by the output buffer BUF may be selected from one of the two second data latches L2A and L2B according to the image pattern of the image frame and the related configuration. In an embodiment, a level shifter may be disposed between the second data latches L2A and L2B and the DAC, to shift the image data to a level adapted to the operating voltage of the panel.

The following tables illustrate the detailed operations of the data latches in the source driver 704, to realize the normal configuration and the swap configurations as mentioned above.

Table 1 illustrates the normal configuration, where the input image data are forwarded to the second data latches L2A and L2B alternately; that is, the image data in odd lines are forwarded to and stored in the second data latch L2A, and the image data in even lines are forwarded to and stored in the second data latch L2B. The data cycle field shows that the line data numbers are received by the source driver 704 in a normal sequence of $1^{st}$, $2^{nd}$, $3^{rd}$ . . . , etc. The fields of L2A and L2B respectively show which line data number is stored in the second data latches L2A and L2B in each data cycle. The output line field shows the number of line data outputted by the source driver 704 in each data cycle. Note that the image data received in each data cycle are outputted in the next data cycle, i.e., with delay of one cycle. The selection field shows that the image data in the second data latch L2A (as denoted by A) or the image data in the second data latch L2B (as denoted by B) is selected to be outputted in each data cycle. Since the input image data are forwarded to the second data latches L2A and L2B alternately and the second data latches L2A and L2B are alternately selected to provide the output image data, the output data sequence of the normal configuration may be realized.

TABLE 1

| Normal configuration | | | | |
|---|---|---|---|---|
| Data cycle | L2A | L2B | Selection | Output line |
| 1 | 1 | NC | | |
| 2 | 1 | 2 | A | 1 |
| 3 | 3 | 2 | B | 2 |
| 4 | 3 | 4 | A | 3 |
| 5 | 5 | 4 | B | 4 |
| 6 | 5 | 6 | A | 5 |
| 7 | 7 | 6 | B | 6 |
| 8 | 7 | 8 | A | 7 |
| 9 | 9 | 8 | B | 8 |
| 10 | 9 | 10 | A | 9 |
| 11 | 11 | 10 | B | 10 |
| 12 | 11 | 12 | A | 11 |
| 13 | 13 | 12 | B | 12 |

Table 2 illustrates the first swap configuration where every $(4n+3)^{th}$ line data and $(4n+4)^{th}$ line data are swapped (see the output line field where the $3^{rd}$ and $4^{th}$ line data are swapped, the $7^{th}$ and $8^{th}$ line data are swapped, and the $11^{th}$ and $12^{th}$ line data are swapped). The image data are configured to be forwarded to and stored in the second data latch L2A or L2B in the manner as shown in Table 2, so as to achieve the swap configuration. In detail, in the first data cycle, the $1^{st}$ line data is received and forwarded to L2A, while L2B contains no image data. In the second data cycle, the $2^{nd}$ line data is received and forwarded to L2B. In this data cycle, the second data latch L2A is selected and the $1^{st}$ line data stored in L2A is outputted. In the third data cycle, the $3^{rd}$ line data is received and forwarded to L2A, since the image data previously stored in L2A has been outputted (i.e., the $1^{st}$ line data). In this data cycle, the second data latch L2B is selected and the $2^{nd}$ line data stored in L2B is outputted. In the fourth data cycle, the $4^{th}$ line data is received and forwarded to L2B, since the image data previously stored in L2B has been outputted (i.e., the $2^{nd}$ line data). In this data cycle, in order to realize data swap between the $3^{rd}$ line data and the $4^{th}$ line data, the image data in the second data latch L2B is selected; that is, the $4^{th}$ line data stored in L2B is outputted. The $3^{rd}$ line data is then outputted in the next data cycle and thus swap of the output orders is realized. Note that after the third data cycle, the newly received image data should be forwarded to one of the second data latches L2A and L2B in which the stored data has been outputted.

In the similar manner, the $5^{th}$ to the $8^{th}$ line data may be forwarded to the second data latches L2B, L2A, L2B and L2A, respectively, as indicated by Table 2. In this embodiment, every 8 line data may be considered as a cycle to follow identical allocation method; that is, the $9^{th}$ to $16^{th}$ line data will repeat the same allocation (to a selected second data latch) as the $1^{st}$ to $8^{th}$ line data, and so on.

TABLE 2

| First swap configuration | | | | |
|---|---|---|---|---|
| Data cycle | L2A | L2B | Selection | Output line |
| 1 | 1 | NC | | |
| 2 | 1 | 2 | A | 1 |
| 3 | 3 | 2 | B | 2 |
| 4 | 3 | 4 | B | 4 |
| 5 | 3 | 5 | A | 3 |
| 6 | 6 | 5 | B | 5 |
| 7 | 6 | 7 | A | 6 |
| 8 | 8 | 7 | A | 8 |
| 9 | 9 | 7 | B | 7 |
| 10 | 9 | 10 | A | 9 |
| 11 | 11 | 10 | B | 10 |
| 12 | 11 | 12 | B | 12 |
| 13 | 11 | 13 | A | 11 |

Table 3 illustrates the second swap configuration where every $(4n+1)^{th}$ line data and $(4n+2)^{th}$ line data are swapped (see the output line field where the $1^{st}$ and $2^{nd}$ line data are swapped, the $5^{th}$ and $6^{th}$ line data are swapped, and the $9^{th}$ and $10^{th}$ line data are swapped). Those skilled in the art should be able to infer the detailed operations of the second swap configuration based on the content of Table 3 and the descriptions in the above paragraphs. Thus, the detailed descriptions related to Table 3 will not be narrated herein.

TABLE 3

| Second swap configuration | | | | |
|---|---|---|---|---|
| Data cycle | L2A | L2B | Selection | Output line |
| 1 | 1 | NC | | |
| 2 | 1 | 2 | B | 2 |
| 3 | 1 | 3 | A | 1 |
| 4 | 4 | 3 | B | 3 |
| 5 | 4 | 5 | A | 4 |
| 6 | 6 | 5 | A | 6 |
| 7 | 7 | 5 | B | 5 |
| 8 | 7 | 8 | A | 7 |
| 9 | 9 | 8 | B | 8 |
| 10 | 9 | 10 | B | 10 |
| 11 | 9 | 11 | A | 9 |

TABLE 3-continued

| Second swap configuration | | | | |
|---|---|---|---|---|
| Data cycle | L2A | L2B | Selection | Output line |
| 12 | 12 | 11 | B | 11 |
| 13 | 12 | 13 | A | 12 |

A source driver of the present invention may include hundreds or thousands of channels, each having the structure as shown in FIG. 8. Therefore, the image data (or line data) in each channel may follow the rule as specified in the above tables, so as to realize the output orders indicated by the normal configuration or the swap configurations.

Please note that the present invention aims at providing a method of controlling image data and a related source driver to achieve power saving by swapping output orders of image data. Those skilled in the art may make modifications and alternations accordingly. For example, in the above embodiments, the swap configurations are applicable to heavy-load image patterns such as the H-line pattern and the sub V-line pattern. However, the applications of the swap configurations are not limited herein. In order to reduce power consumption, any image frame that may generate large power consumption may be dealt with via an appropriate swap configuration. In addition, the driving system and the source driver of the present invention are capable of outputting image data to a panel in any possible sequence, and are applicable to any type of panel such as a liquid crystal display (LCD), an organic light-emitting diode (OLED) panel, and the like. Further, in the above embodiments, the timing controller determines whether swap of line data is required and determines a configuration to output the line data in a sequence, e.g., according to the pattern detection result. In another embodiment, the determinations of swap configuration may be performed by the source driver, as will be described below.

Figure 9:
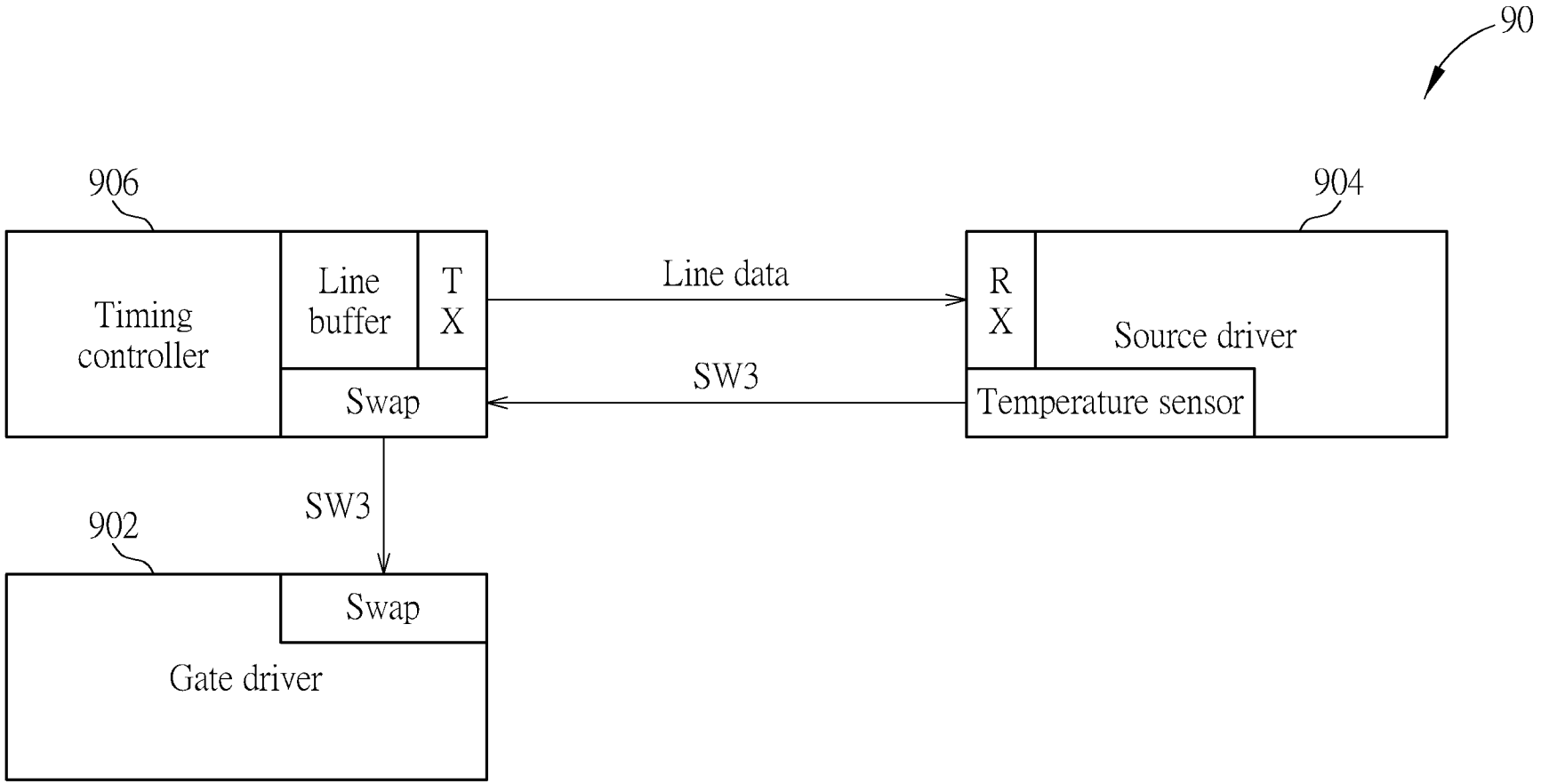
FIG. 9 is a schematic diagram of a driving system according to an embodiment of the present invention.

Please refer to FIG. 9, which is a schematic diagram of a driving system 90 according to an embodiment of the present invention. As shown in FIG. 9, the driving system 90 includes a gate driver 902, a source driver 904 and a timing controller 906. The operations of the gate driver 902, the source driver 904 and the timing controller 906 are similar to those of the gate driver 602, the source driver 604 and the timing controller 606 in the driving system 60, so signals and elements having similar functions are denoted by the same symbols. The difference between the driving system 90 and the driving system 60 is that, in the driving system 90, the configuration related to the output sequence of line data is determined by the source driver 904 rather than the timing controller 906. In detail, the source driver 904 may include a temperature sensor, which is capable of detecting the temperature of the source driver 904. The source driver 904 may determine to output the image frame with a configuration according to the temperature detection result. For example, when the temperature sensor detects that the temperature is greater than a threshold, e.g., 120° C., a swap configuration may be applied to the current frame of image data, no matter whether the image pattern of the frame is a heavy-load pattern or not. In such a situation, the temperature sensor of the source driver 904 may send a swap signal SW3 to the timing controller 906, to notify the timing controller 906 that the swap configuration for image data is applied to the image frame. Upon receiving the swap signal SW3 from the source driver 904, the timing controller 906 may forward the swap signal SW3 (or send another similar control signal) to the gate driver 902, to control the gate driver 902 to output or trigger the gate driving signals in a sequence corresponding to the output orders of the line data.

Figure 10:
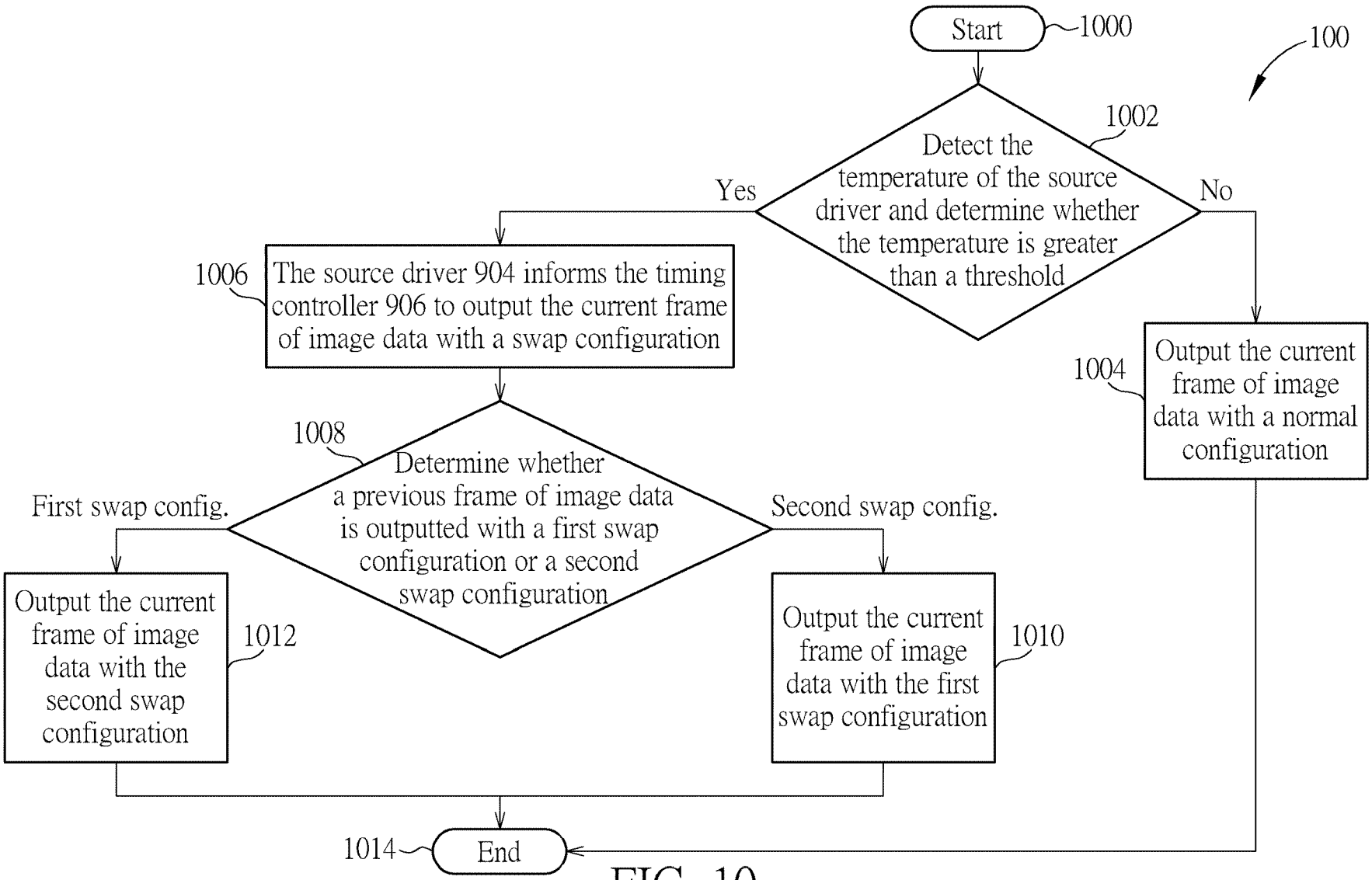
FIG. 10 is a flowchart of an image control process according to an embodiment of the present invention.

The detailed implementations of the driving system 90 may be summarized into an image control process 100, as shown in FIG. 10. The image control process 100 includes the following steps:

Step 1000: Start.

Step 1002: Detect the temperature of the source driver and determine whether the temperature is greater than a threshold. If yes, go to Step 1006; otherwise, go to Step 1004.

Step 1004: Output the current frame of image data with a normal configuration. Then go to Step 1014.

Step 1006: The source driver 904 informs the timing controller 906 to output the current frame of image data with a swap configuration.

Step 1008: Determine whether a previous frame of image data is outputted with a first swap configuration or a second swap configuration. If the previous frame of image data is outputted with the second swap configuration, go to Step 1010; if the previous frame of image data is outputted with the first swap configuration, go to Step 1012.

Step 1010: Output the current frame of image data with the first swap configuration. Then go to Step 1014.

Step 1012: Output the current frame of image data with the second swap configuration.

Step 1014: End.

As can be seen, the image control process 100 is different from the image control process 40 in that, the source driver 904 detects its temperature and proactively determines the configuration for the output sequence. In addition, in the image control process 100, the source driver 904 informs the timing controller 906 to output the image frame with a swap configuration if the temperature exceeds the threshold. This means that the swap scheme is implemented in the timing controller 906, and thus a line buffer is disposed in the timing controller 906 to store line data previously received but outputted later, so as to realize the swap operations.

In another embodiment, the swap scheme may be implemented in the source driver 904 instead, where the source driver 904 may include additional second data latches as the structure shown in FIG. 8, to swap the output orders in the channels of the source driver 904. In such a situation, the source driver 904 may send a swap signal to the gate driver 902 directly or via the timing controller 906, to instruct the gate driver 902 to change the orders of outputting or triggering the gate driving signals correspondingly.

In a further embodiment, there may be multiple source drivers in a driving system, and the temperature sensor may detect the temperature of each of the source drivers and thereby perform determination on the configuration of output orders, to realize a more complete overheating protection.

In addition, the temperature detection operation of the source driver may be combined with the PDF of the timing controller. In an exemplary embodiment, the swap configuration may be triggered when either the detected temperature exceeding the threshold or the incoming image frame determined to be a heavy-load frame happens.

Please note that the present invention controls the line data in an image frame to be outputted with a swap configuration or a normal configuration, which may be considered as a frame-based operation. More specifically, before a frame of image data is outputted from the timing controller, the timing controller (or the source driver) may determine that this image frame should follow a configuration to be outputted in a swap sequence or normal sequence, and thus apply the selected configuration to all line data of this image frame. Such a swap scheme is dedicated to specific heavy-load image patterns. Since the power consumption performance is usually worse in the heavy-load image patterns, the frame-based swap operation that can deal with the heavy-load image patterns is enough to significantly improve the power consumption performance, while complex computation or comparison of line data is not necessary. In such a situation, the power saving effects may be achieved without boosting the costs.

To sum up, the embodiments of the present invention provide a method of controlling image data and a related source driver, to achieve power saving by swapping the output orders of image data. The timing controller may detect the image pattern of the received image frame, to determine whether the image pattern is identical to or similar to a heavy-load pattern. When determining that the image pattern belongs to the heavy-load pattern, the timing controller may apply a swap configuration to the image frame, to output the line data in the image frame with a swap sequence or control the source driver to output the line data in the image frame with a swap sequence. Therefore, the swap of output orders may be implemented in the timing controller or the source driver according to system requirements. The timing controller may further send a swap signal to the gate driver, to instruct the gate driver to change the output orders of gate driving signals correspondingly. In an embodiment, the source driver may include an additional second data latch in each channel, allowing a previously received image data to be outputted later by allocating the image data to one of the second data latches and selecting to output the image data from one of the second data latches in each data cycle. In an embodiment, more than one swap configuration may be predetermined in the system; hence, two or more different swap configurations may be applied alternately, to control the output brightness of image frames to be well balanced by mitigating the insufficient charging problem in the heavy-load image frames. Alternatively or additionally, the temperature of the source driver may be detected and taken as a basis for determining whether to apply the swap configuration to the incoming image frame. The swap configuration may be performed if the temperature exceeds a threshold. According to swap of output orders of image data proposed in the present invention, power saving may be achieved for heavy-load image patterns, and the overheating problem may also be resolved or mitigated due to reduction of power consumption.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of controlling image data, comprising:

detecting a current frame of image data to determine an image pattern of the current frame of image data; and determining to output the current frame of image data with one of a plurality of configurations according to the image pattern;

wherein the plurality of configurations comprise a normal configuration, a first swap configuration and a second swap configuration;

wherein the current frame of image data comprises a plurality of line data, and the plurality of line data are separated into a plurality of groups;

wherein in the normal configuration, the plurality of image data are outputted to a panel from up to down, and in the first swap configuration and the second swap configuration, output orders of at least two line data in each of the plurality of groups of line data are swapped with reference to the normal configuration;

wherein the first swap configuration and the second swap configuration indicate different output sequences of the plurality of line data; and wherein the step of determining to output the current frame of image data with one of the plurality of configurations according to the image pattern comprises:

performing the following steps when the image pattern is determined to be a heavy-load pattern:

determining whether a previous frame of image data is outputted with the first configuration or the second configuration;

outputting the current frame of image data with the first configuration when the previous frame of image data is outputted with the second configuration; and outputting the current frame of image data with the second configuration when the previous frame of image data is outputted with the first configuration.

2. The method of claim 1, further comprising:

outputting, by a timing controller, the current frame of image data to a source driver in a sequence indicated by the one of the plurality of configurations determined by the timing controller.

3. The method of claim 1, further comprising:

outputting, by a timing controller, the current frame of image data to a source driver in a normal sequence; and outputting, by the source driver, the current frame of image data to a panel in a sequence indicated by the one of the plurality of configurations determined by the timing controller.

4. The method of claim 1, further comprising:

detecting a temperature of a source driver; and determining to output the current frame of image data with one of the plurality of configurations according to the temperature of the source driver.

5. The method of claim 4, wherein the step of determining to output the current frame of image data with one of the plurality of configurations according to the temperature of the source driver comprises:

applying a swap configuration among the plurality of configurations to the current frame of image data when the temperature is greater than a threshold.

6. The method of claim 1, wherein when the current frame of image data is outputted with the first swap configuration, output orders of a first line data and a second line data in each of the plurality of groups of line data are swapped with reference to the normal configuration.

7. The method of claim 6, wherein the plurality of groups of line data comprise $(4n+3)^{th}$ line data and $(4n+4)^{th}$ line data among the current frame of image data, wherein n is a positive integer, and in the first swap configuration, the output orders of the $(4n+3)^{th}$ line data and the corresponding $(4n+4)^{th}$ line data are swapped with reference to the normal configuration.

8. The method of claim 6, wherein when the current frame of image data is outputted with the second swap configuration, output orders of a third line data and a fourth line data in each of the plurality of groups of line data are swapped with reference to the normal configuration.

9. The method of claim 8, wherein the plurality of groups of line data comprise $(4n+1)^{th}$ line data and $(4n+2)^{th}$ line data among the current frame of image data, wherein n is a positive integer, and in the second swap configuration, the output orders of the $(4n+1)^{th}$ line data and the corresponding $(4n+2)^{th}$ line data are swapped with reference to the normal configuration.

10. The method of claim 8, wherein the first swap configuration and the second swap configuration are interchangeably applied to a plurality of image frames when image patterns of the plurality of image frames indicate that swapping of line data is required in the plurality of image frames.

* * * * *